US008516965B2

(12) United States Patent
Pier et al.

(10) Patent No.: US 8,516,965 B2
(45) Date of Patent: Aug. 27, 2013

(54) AUTOMATIC SPIKE FEEDER SYSTEM

(75) Inventors: Michael T. Pier, Fox Point, WI (US); Robert A. Butschle, Milwaukee, WI (US)

(73) Assignee: Nordco Inc., Oak Creek, WI (US)

( * ) Notice: Subject to any disclaimer, the term of this patent is extended or adjusted under 35 U.S.C. 154(b) by 219 days.

(21) Appl. No.: 13/053,523

(22) Filed: Mar. 22, 2011

(65) Prior Publication Data

US 2012/0240810 A1 Sep. 27, 2012

(51) Int. Cl.
*E01B 29/26* (2006.01)

(52) U.S. Cl.
USPC ..... 104/17.1; 198/396

(58) Field of Classification Search
USPC ..... 104/17.1; 198/396
See application file for complete search history.

(56) References Cited

U.S. PATENT DOCUMENTS

| | | | | |
|---|---|---|---|---|
| 1,615,137 | A | 2/1930 | Ruby | |
| 1,747,140 | A | 2/1930 | Smith | |
| 3,203,590 | A | 8/1965 | Maki | |
| 3,581,665 | A | 6/1971 | Johnson | |
| 3,907,099 | A | 9/1975 | Smith | |
| 4,014,460 | A * | 3/1977 | Bryan, Jr. | 221/156 |
| 6,155,175 | A * | 12/2000 | Rude et al. | 104/17.1 |
| 6,257,395 | B1 * | 7/2001 | Yokajty et al. | 198/580 |

* cited by examiner

*Primary Examiner* — S. Joseph Morano
*Assistant Examiner* — Zachary Kuhfuss
(74) *Attorney, Agent, or Firm* — Greer, Burns & Crain, Ltd.

(57) ABSTRACT

An automatic rail spike feeder system for use with a rail maintenance vehicle having a bulk storage bin for containing a supply of spikes, and at least one spike driving mechanism, includes a mechanism constructed and arranged for receiving a supply of spikes from the storage bin and for automatically delivering individual spikes to the at least one spike driving mechanism in a desired orientation without operator contact of the spikes.

14 Claims, 20 Drawing Sheets

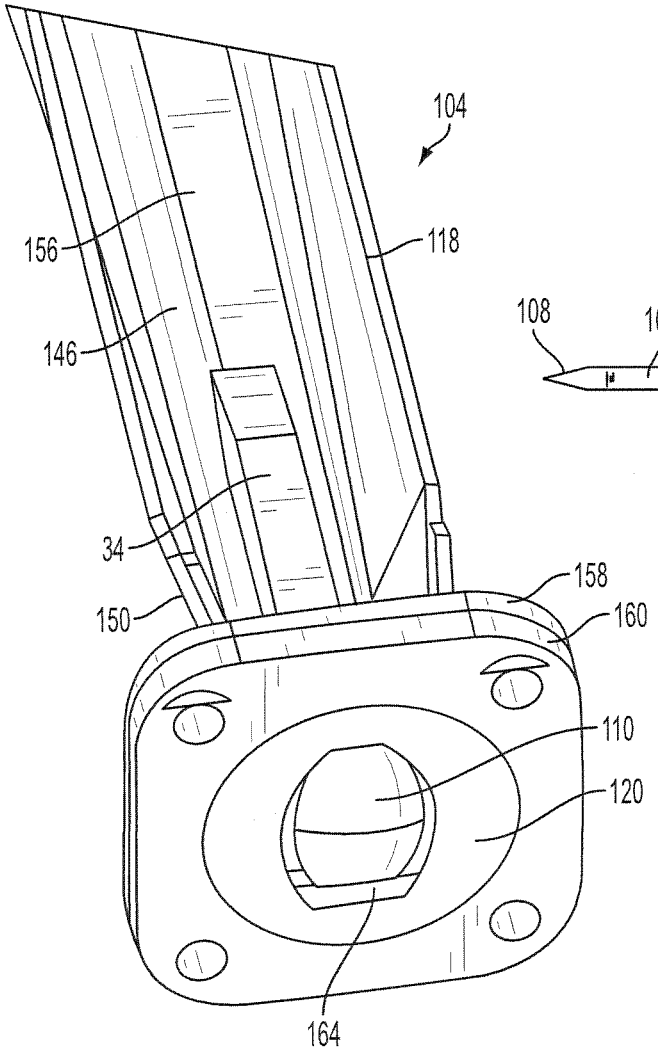
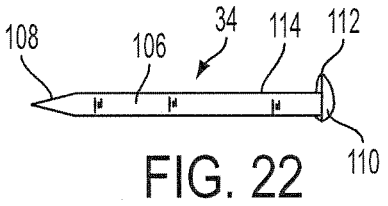
FIG. 22
FIG. 21

AUTOMATIC SPIKE FEEDER SYSTEM

RELATED APPLICATIONS

The present application is related to commonly assigned, co-pending U.S.Patent Applications for Singulator for Sorting Random Items application Ser. No. 13/053,531), and for Tray for Orienting and Conveying Items application Ser No. 13/053,526), both of which are incorporated by reference.

BACKGROUND

The present invention relates generally to material handling equipment, and more specifically to rail maintenance equipment for orienting, sorting and conveying rail fasteners such as cut spikes to a fastener applicator, such as a spike driver.

While the present application is intended for use in handling and sorting rail spikes, it is contemplated that the present apparatus is usable in orienting other rail fasteners such as lag bolts, hairpin spikes, Lewis bolts and the like, as well as other spikes needing repositioning while being conveyed to an operational destination. Thus, "spikes" will be broadly interpreted in the present application. Currently, rail spikes used in a rail maintenance gang are stored in bulk and delivered in relatively small groups to an operator station. One such apparatus employs a reciprocating ram located at the bottom of a storage bin, as disclosed in commonly-assigned U.S. Pat. No. 7,216,590 which is incorporated by reference. In conventional rail maintenance operations employing the reciprocating ram, a small group of spikes is provided by the ram to a delivery location. A designated operator draws individual spikes from the small group supplied by the ram, manually orients them in proper top-to-bottom and front-to-back position, and inserts them into a feed tray of a rail fastener driver magazine, of the type disclosed in commonly-assigned U.S. Pat. Nos. 5,398,616; 5,465,667 and 7,104,200, all of which are incorporated by reference. Manual loading of such feed trays is a tedious task, which also distracts the attention of the operator who is also controlling the spike driving operation. In some cases, to divide these tasks, two operators are provided, one to load the spike tray and one to control the spike driving mechanism, however there is a resulting additional labor cost to the railroad for performing the spiking operation.

There is a continuing motivation by railroads to reduce the required labor of rail maintenance operations. Accordingly, maintenance machinery manufacturers have attempted to automate tasks where possible.

SUMMARY

The above-identified need for continued automation of rail maintenance tasks is met by the present automatic spike feeder system. A singulator receives a group of spikes from the reciprocating ram, and delivers individual spikes to a conveyor. The conveyor is constructed and arranged to feed either or both sides of a rail maintenance apparatus at sufficient speed to supply a spike driver. A spike orienting tray is located at a delivery end of the conveyor, receives randomly oriented spikes, and without operator input, orients the spikes in proper tip down, head up orientation suitable for feeding a magazine of the spike driver. Thus, with the present spike delivery and orientation system, a single operator can operate a spike driver and be assured of an adequate supply of spikes without being distracted from his main task. Further, the present system is configured for delivering approximately 40 spikes per minute (SPM) per rail. This typically breaks down to 20 SPM from each spike driver gun. When two rails are being worked on simultaneously, the system delivers 10 SPM to each spiker gun.

Another feature of the present conveyor system is that it selectively provides spikes to spike drivers associated with each rail, or to drivers on both sides of a single rail. Thus, from one to four spike drivers are optionally supplied with spikes by the present conveyor system.

More specifically, an automatic rail spike feeder system is provided for use with a rail maintenance vehicle having a bulk storage bin for containing a supply of spikes, and at least one spike driving mechanism, and includes a mechanism constructed and arranged for receiving a supply of spikes from the storage bin and for automatically delivering individual spikes to the at least one spike driving mechanism in a desired orientation without operator contact of the spikes.

In another embodiment, an automatic spike feeder system is provided for automatically conveying spikes from a bulk storage bin to a spike driving mechanism, and includes a singulator configured for receiving groups of randomly-oriented spikes from the storage bin and including at least one vertically reciprocating elevator for isolating single spikes for delivery. At least one conveyor is disposed for receiving spikes delivered by the singulator and for conveying them to at least one designated spike tray. Each spike tray is constructed and arranged for automatically and statically orienting single spikes from a random orientation to delivery in a designated tip down orientation for delivery to the spike driving mechanism, such that the spikes are conveyed from the storage bin to the spike driving mechanism without operator contact.

In yet another embodiment, an automatic spike feeder system is provided for automatically conveying rail spikes from a bulk storage bin to a spike driving mechanism, and includes a separator configured for receiving a supply of the spikes and separating a portion of the supply for orientation, a singulator configured for receiving groups of randomly-oriented spikes from the separator and including at least one vertically reciprocating elevator for isolating single spikes for delivery. At least one conveyor is disposed for receiving spikes delivered by the singulator and conveying them to at least one designated spike tray. The at least one spike tray is constructed and arranged for receiving the single spikes from the singulator and for automatically and statically orienting the single spikes from a random orientation to delivery in a designated tip down orientation for delivery to the spike driving mechanism, such that the spikes are conveyed from the storage bin to the spike driving mechanism without operator contact.

BRIEF DESCRIPTION OF THE DRAWINGS

FIG. 21 is a top perspective view of the outlet end of the Orientation Chute with an entry cross-section through the Orientation Twist taken along the line 21-21 of FIG. 15 and in the direction generally indicated;

FIG. 22 is a side view of a rail spike in a head up orientation;

DETAILED DESCRIPTION

Figure 1:
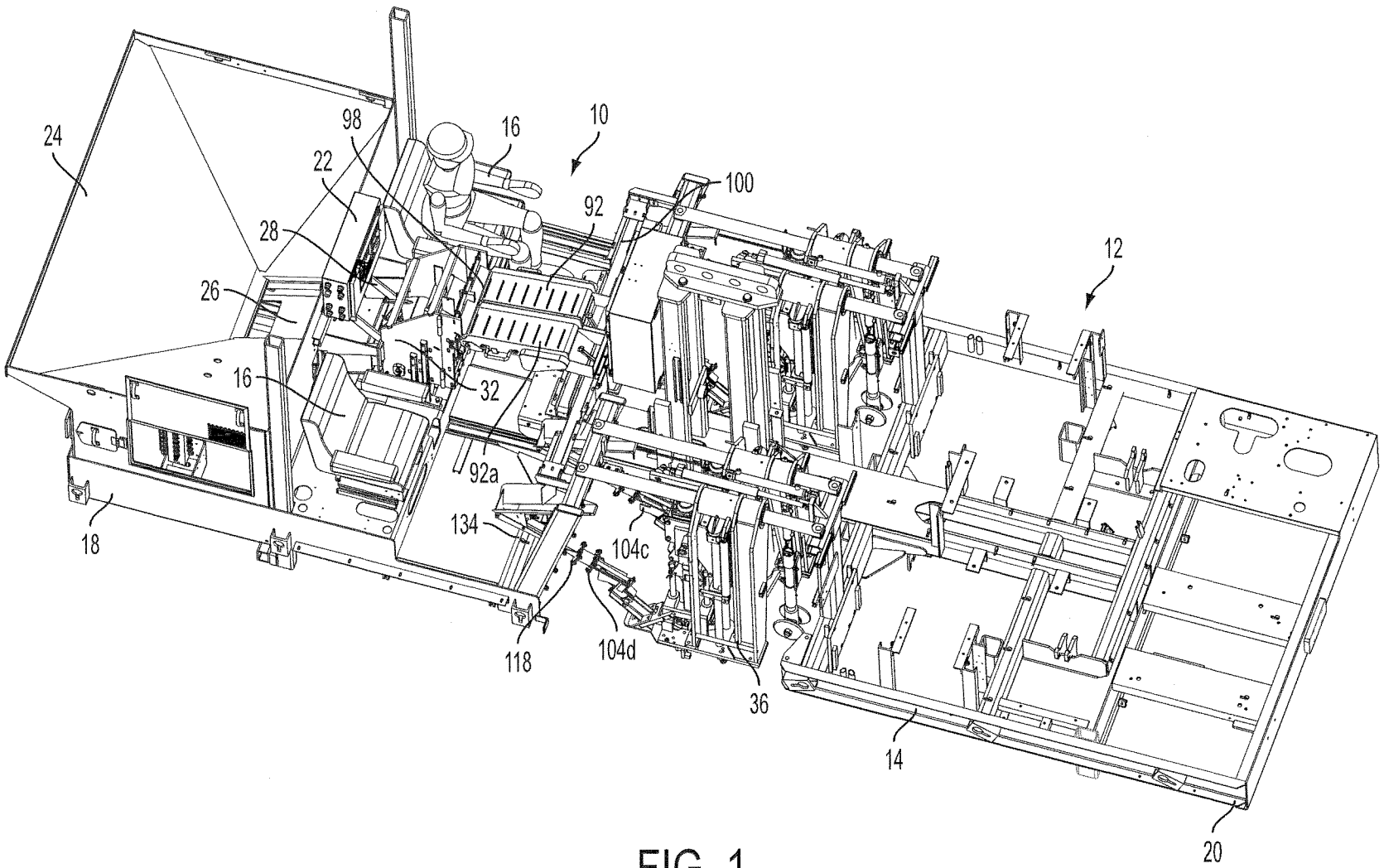
FIG. 1 is a fragmentary top perspective view of a rail maintenance machine provided with the present automatic spike feed system.
Figure 2:
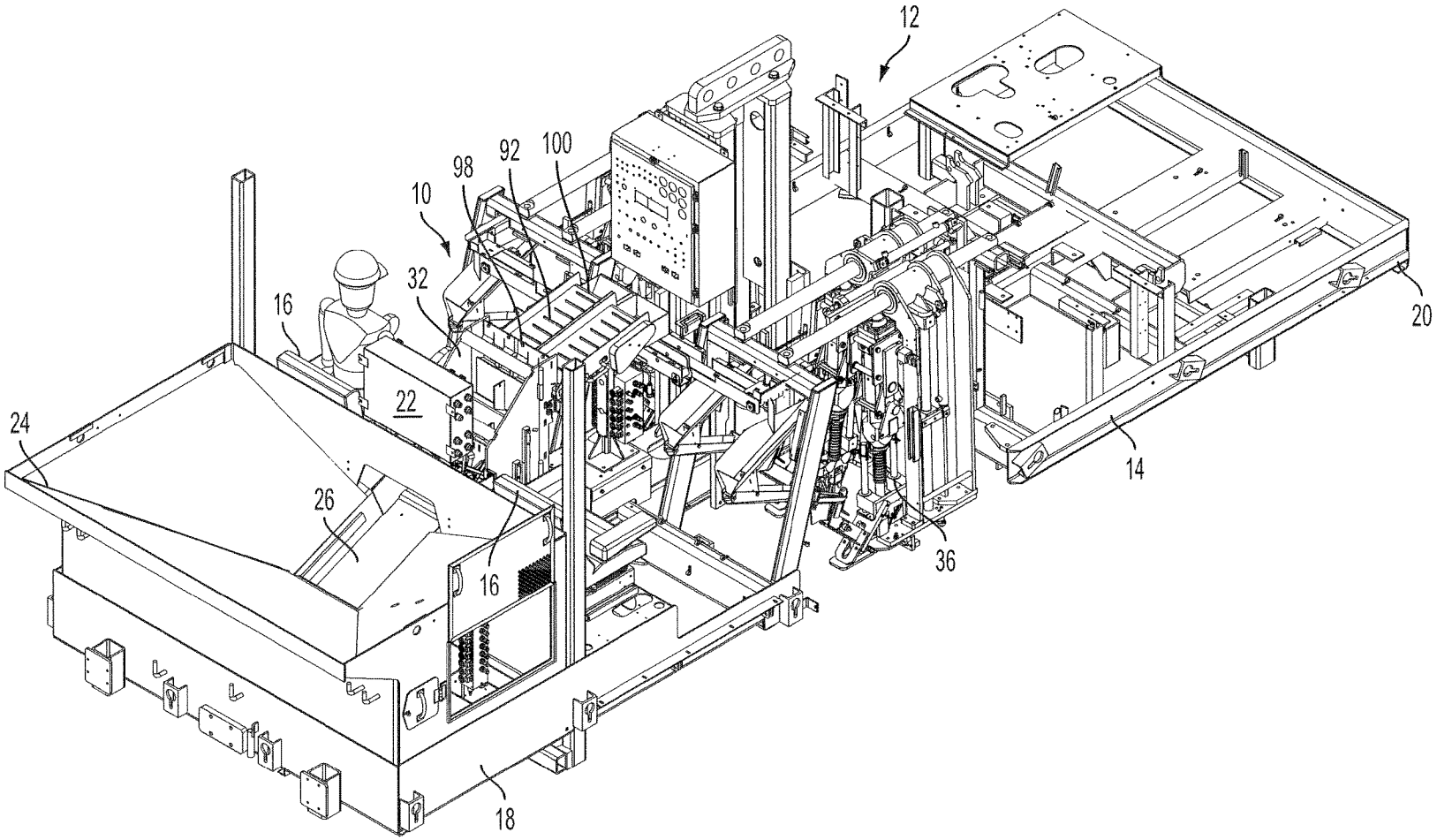
FIG. 2 is a fragmentary rear perspective view of the machine of FIG. 1.

Referring now to FIGS. 1-4, a railway maintenance vehicle fitted with the present automatic spike feeder system, generally designated 10, is itself generally designated 12. As is common in such vehicles, as described in commonly-assigned U.S. Pat. Nos. 5,398,616; 5,465,667 and 7,104,200 incorporated by reference, a machine frame 14 is configured for movement upon a railroad track, and includes a power source, rail bogie wheels, a fluid power (typically hydraulic) system (none of which are shown for enhancing the visibility of the present system 10), as well as at least one operator station 16. While variations are contemplated, in the preferred embodiment, there are two operator stations 16 located closer to a rear end 18 of the frame than to a front end 20. It should be understood that the described arrangement of the components of the system 10 on the frame 14 should be considered exemplary only, and may vary to suit the situation. It is also contemplated that the machine 12 is either self-propelled or towed by another rail maintenance vehicle (not shown) also as is well known in the art. A control system 22, visually depicted as a logic box and having at least one PLC, is preferably located between the operator stations 16, however other locations are contemplated depending on the application. A first component of the system 10 is a bulk storage bin 24, which stores a supply of bulk spikes. At a lower end of the bin 24, a reciprocating, preferably fluid-powered ram 26 delivers a supply of spikes to an arcuately reciprocating separator or isolation wedge 28. The construction and operation of the ram 26 is described in detail in U.S. Pat. No. 7,216,590, which is incorporated by reference.

Figure 5:
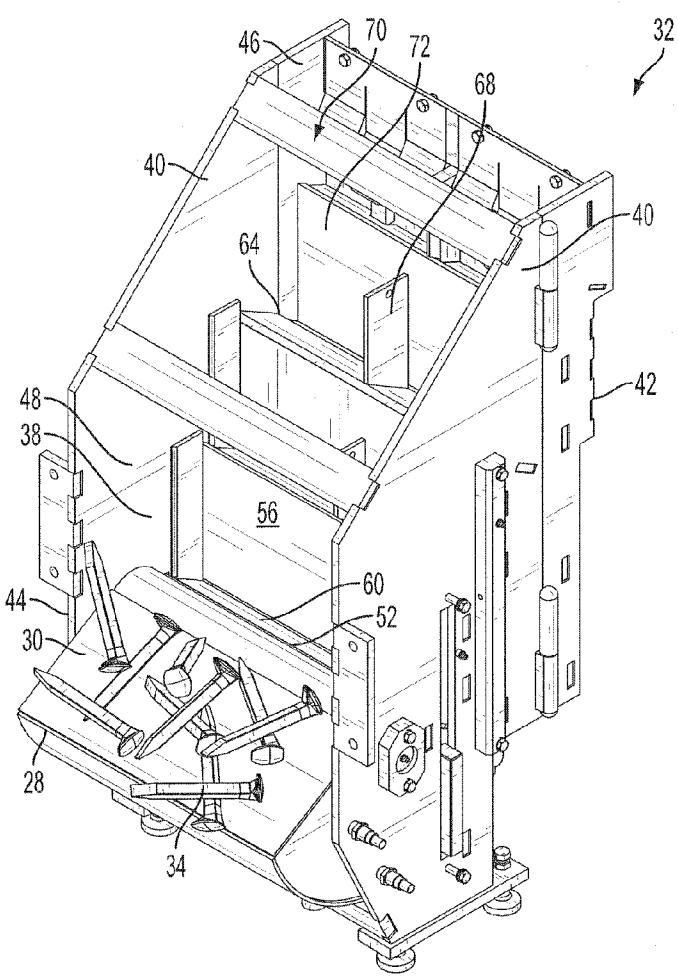
FIG. 5 is a top perspective view of a singulator suitable for use with the present system.
Figure 8:
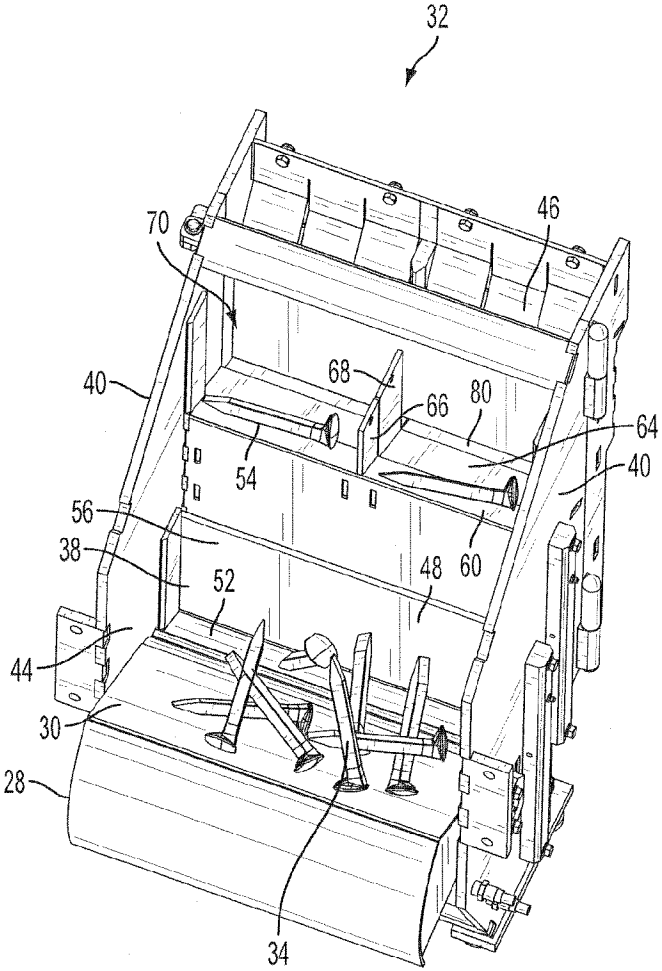
FIG. 8 is a top perspective view of the present singulator with spikes caught on the second platforms as the second stage moves upward and the first stage moves downward.

The separator 28 is configured for receiving a supply of the spikes from the ram 26 and separating a portion of the supply for orientation. In the preferred embodiment, the separator 28 is wedge-shaped when viewed from the side, defining a flat, somewhat inclined top surface 30 (FIG. 5) and is connected to a singulating device or singulator 32. The separator 28 is mounted to the singulator so that an attached end rotates about a transverse, generally horizontal axis a platform for receiving the portion and pivoting from a first position adjacent the supply to a second position inclined relative to the first position for delivering the portion to the singulator 32. Thus, spikes received upon the top surface 30 from the ram 24 are fed by upward rotation and the resulting increasing inclination of the top surface for delivering the spikes to the singulator 32.

Referring now to FIGS. 1-3 and 5-14, the singulator 32 is configured for receiving a supply of spikes 34 from the separator 28 in bulk, random oriented fashion, and sorting the spikes so that individual spikes are delivered, preferably in horizontal orientation transverse to the direction of travel, for eventual delivery to a spike driving mechanism, also referred to as a spike driver gun 36. A feature of the present system 10 is that it is constructed and arranged for receiving a supply of the spikes 34 from the storage bin 24 and for automatically delivering individual spikes to the spike driving mechanism 36 in a desired orientation without operator contact of the spikes.

Referring now to FIGS. 5-14, while details of the singulator 32 are provided in co-pending, commonly-assigned U.S. pat. application Ser. No. 13/053,531, incorporated by reference, the reciprocating separator 28 delivers a supply of the spikes 34 into a work chamber 38 defined by side plates 40 and rear plates 42 of the singulator 32. A lower end 44 of the work chamber 38 is adjacent the separator 26, and an upper end 46 is opposite the lower end. Thus, movement of spikes through the singulator 32 is upward and away from both the separator 26 and a primary elevator 48 of the singulator. A transverse transition piece 50 (FIG. 6) is attached at each end to a respective one of the side plates 40 and is mounted between the separator 28 and the primary elevator 48 to prevent the spikes 34 from becoming jammed in a space between these components, while permitting free movement of the separator.

Referring now to FIGS. 5-9, in the work chamber 38, the primary elevator 48 includes at least one and preferably two stages of vertically reciprocating elevators, designated a first stage 52 and a second stage 54. The first and second stages 52, 54 are oriented in generally vertical, adjacent and parallel relationship to each other and are separated by a vertical plate 56 fixed to the singulator 32. The plate 56 separates the first and second stages 52, 54 and provides a backstop for the spikes 34 as they are moved upwards by the reciprocating stages. Fluid power, preferably hydraulic cylinders 58 (FIG. 6) secured to the singulator 32 power the stages 52, 54. Each of the stages 52, 54 is provided with a respective first platform 60, 62 reciprocating between a first lower position (FIG. 5 for the first stage 52, FIG. 7 for the second stage 54) in which the platform receives and holds a limited number, preferably four or five, of the spikes 34 delivered from bulk storage, and a first upper position (FIG. 7 for the first stage 52) in which the spikes are ultimately delivered.

Figure 6:
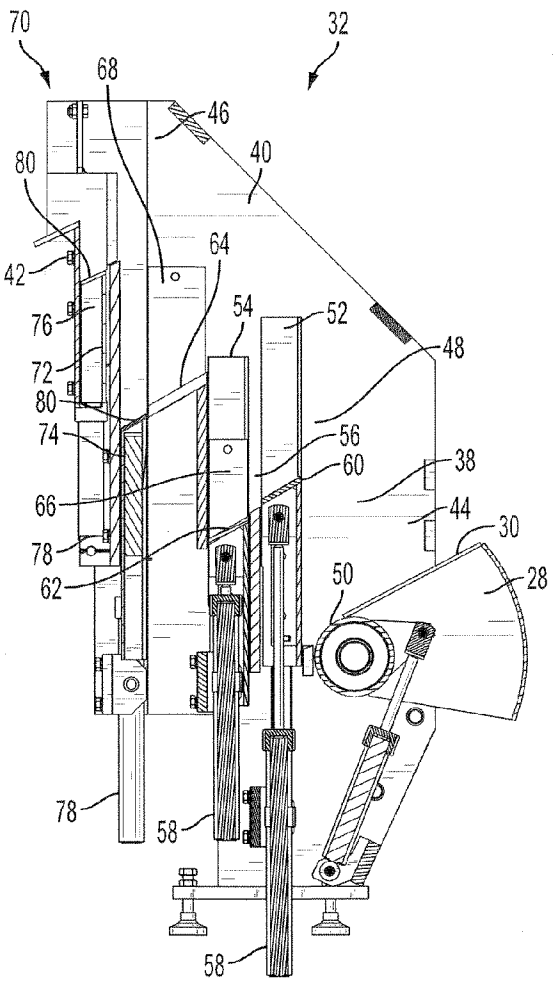
FIG. 6 is a fragmentary side elevation of the singuator of FIG. 5, with portions removed for clarity.
Figure 7:
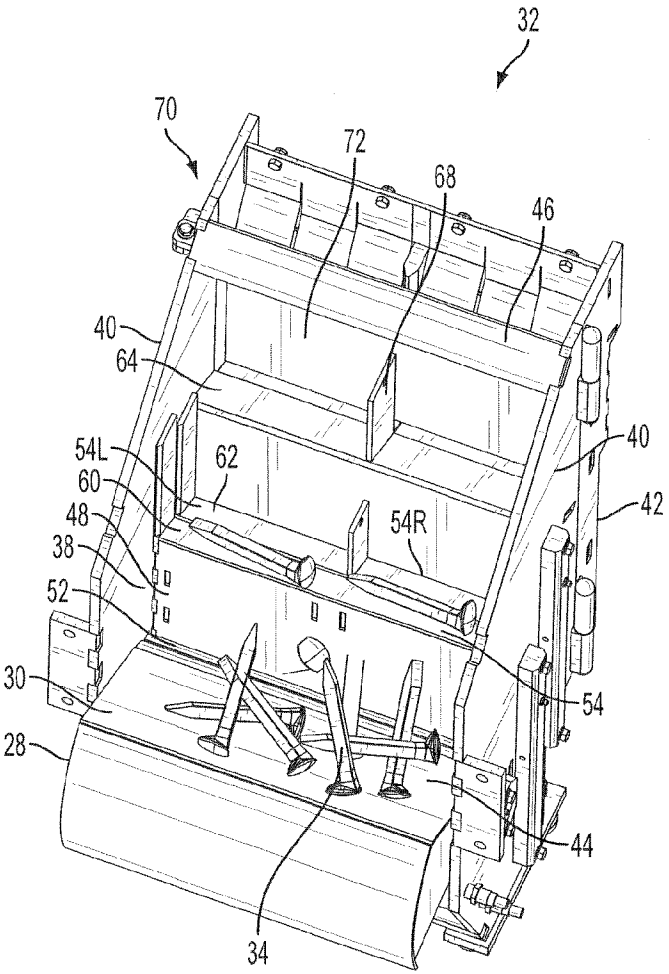
FIG. 7 is a top perspective view of the present singulator with spikes caught on the first platforms as the first stage moves upward, and the second stage moves downward.
Figure 10:
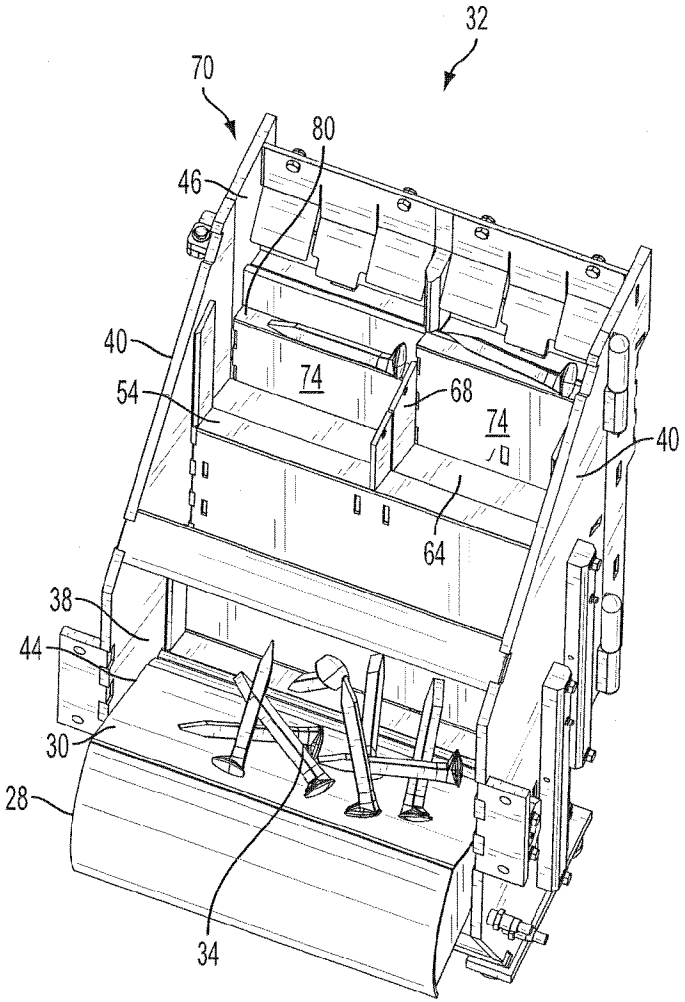
FIG. 10 is top perspective view of the present singulator showing spikes moving from the third stage to the fourth stage.

Since the first and second stages 52, 54 are powered in equal and opposite relation to each other, one is in an uppermost position while the other is in a lowermost position (closer to the separator 28) to facilitate the sorting and separating of the spikes 34 provided by the separator. FIGS. 6 and 7 depict the first stage 52 in an uppermost position and the second stage 54 in a lowermost position. During this operation, spikes 34 will be transferred from the corresponding platform 60 of the first stage 52 to a platform 62 of the second stage 54. The goal of the primary elevator 48 is to deliver a limited supply of horizontally oriented spikes 34 to a stationary shelf 64 (FIGS. 5 and 7) where they reside temporarily before further handling. To facilitate this transfer, both of the platforms 60, 62 are inclined so that a lower edge is adjacent the shelf 64 and the spikes 34 slide by gravity upon the shelf, since an uppermost travel limit of the second stage 54 is higher on the singulator 32 than the shelf.

It should be noted that the shelf 64 is preferably located approximately midway up the total height of the singulator 32. The shelf 64 provides a temporary storage area for the spikes conveyed by the primary elevator 48. This temporary storage area promotes constant flow of the spikes 34 at a desired velocity. It is also preferred, to speed the delivery of spikes 34, that the second stage 54 of the primary elevator 48 includes adjacent pairs of platforms 62 (FIGS. 6 and 7) for defining multiple supply paths 54L, 54R of the spikes to the desired location. In the preferred embodiment, the second stage 54 is provided with a vertically projecting divider bar 66 (FIGS. 6 and 8) fixed to the platform 62 for defining the adjacent supply paths 54L, 54R. On the fixed shelf 64, another fixed vertical divider plate 68 is provided for maintaining the multiple paths.

Figure 9:
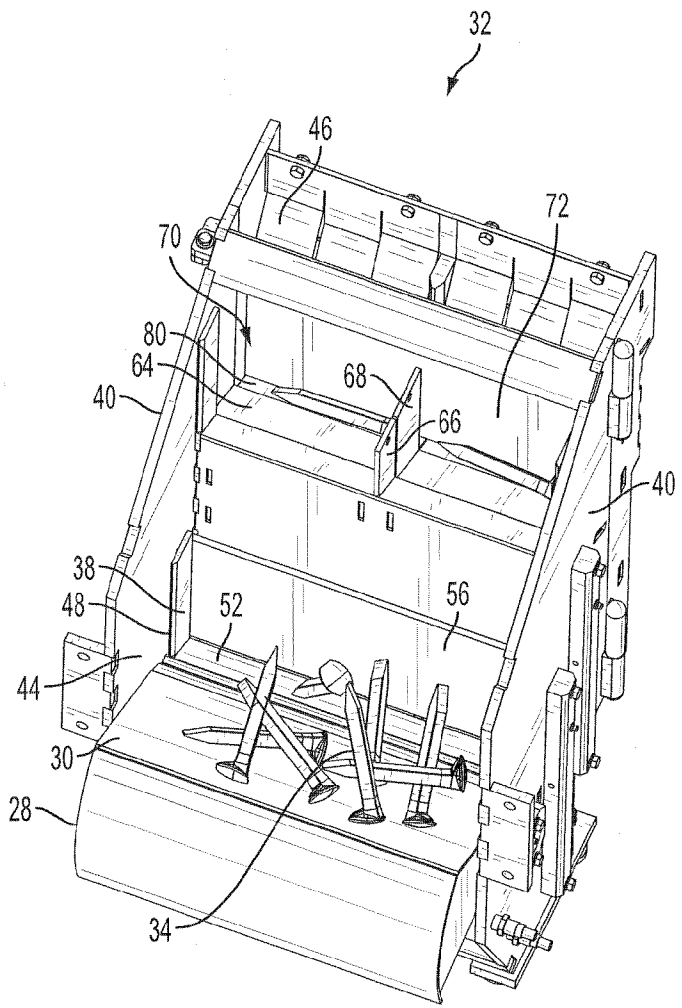
FIG. 9 is a top perspective view of the present singulator showing spikes moving from a stationary shelf on onto the third stage, a first step in the secondary elevator.

Referring now to FIG. 9, once on the stationary shelf 64, the spikes 34 are now horizontally oriented in a direction transverse to the direction of travel of the spikes through the singulator 32. Since the shelf 64 is inclined in the same manner and at about the same angle (approximately) 25-30° as the first platforms 60, 62, the spikes 34 eventually slide by gravity to a secondary elevator 70, and in this manner the delivery of spikes is facilitated. A vertical plate 72 (FIGS. 5, 6, and 9) is fixed to the singulator 32 in similar fashion to the plate 56 for retaining or forming a back stop for any spikes 34 that slide forward from the shelf 64 onto the secondary elevator 70.

Referring now to FIGS. 4, 6 and 8-11, similar to the primary elevator 48, the secondary elevator 70 includes at least one and preferably two stages of vertically reciprocating elevators, designated a third stage 74 and a fourth stage 76. The third and fourth stages 74, 76 are oriented in generally vertical, adjacent and parallel relationship to each other and are powered by corresponding fluid power cylinders 78 secured to the singulator 32 (FIG. 6). Each of the stages 74, 76 is provided with a second platform 80 reciprocating between a second lower position (FIG. 6, stage 74) in which the platform receives and holds a further limited number, preferably one or two, of the spikes 34 received from the primary elevator 48 and the stationary shelf 64, and a second upper position (FIG. 6, stage 76) in which the spikes are ultimately delivered. In the preferred embodiment each second platform 80 has a length of approximately 8.75 inches to accommodate the length of a conventional spike 34 and to allow some freedom of movement of the spike on the platform. Each of the platform sections 62 on the divided stage 54 has a similar dimension.

Since the secondary elevator 70 receives the spikes 34 in a generally horizontal, transverse orientation to the direction of travel of the spikes through the singulator 32, this orientation is maintained. However, misaligned spikes 34 are permitted at this point in the operational sequence. A main function of the secondary elevator 70 is to further reduce the spikes 34 so that only one or two are delivered at a time to the desired location.

Figure 12:
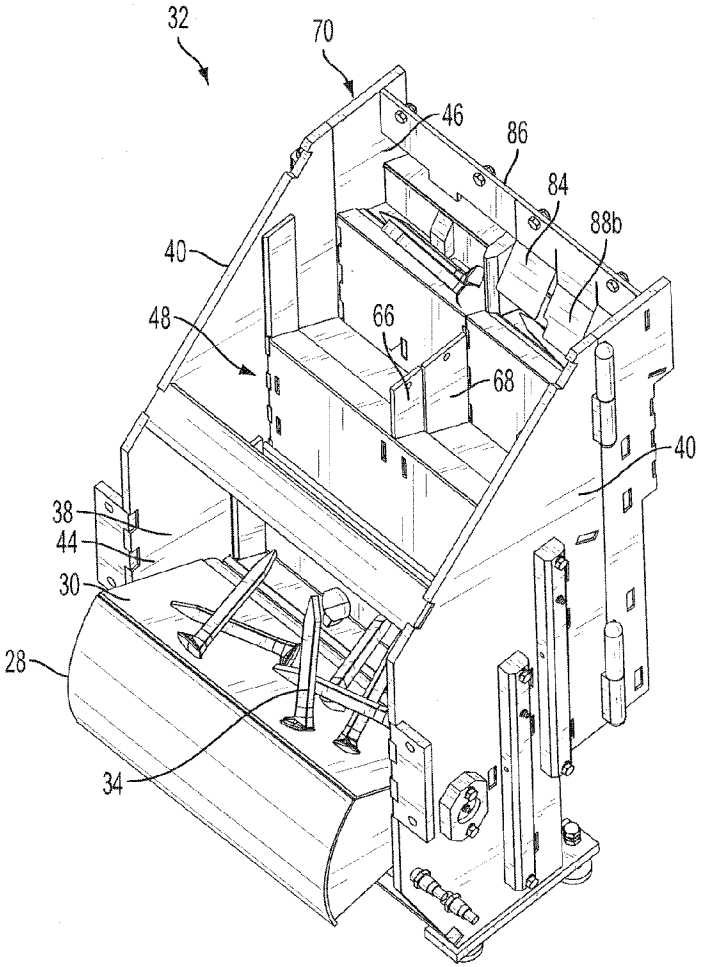
FIG. 12 is a fragmentary top perspective view of the present singulator in operation with spikes on a platform of the fourth stage.
Figure 11:
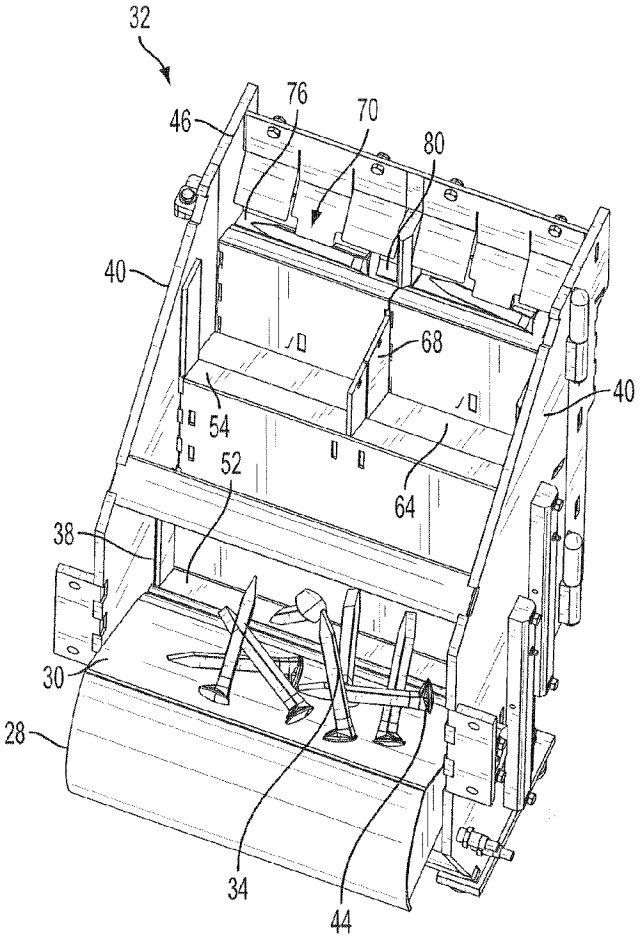
FIG. 11 is a top perspective of the present singulator showing the fourth stage reaching the delivery position.
Figure 13:
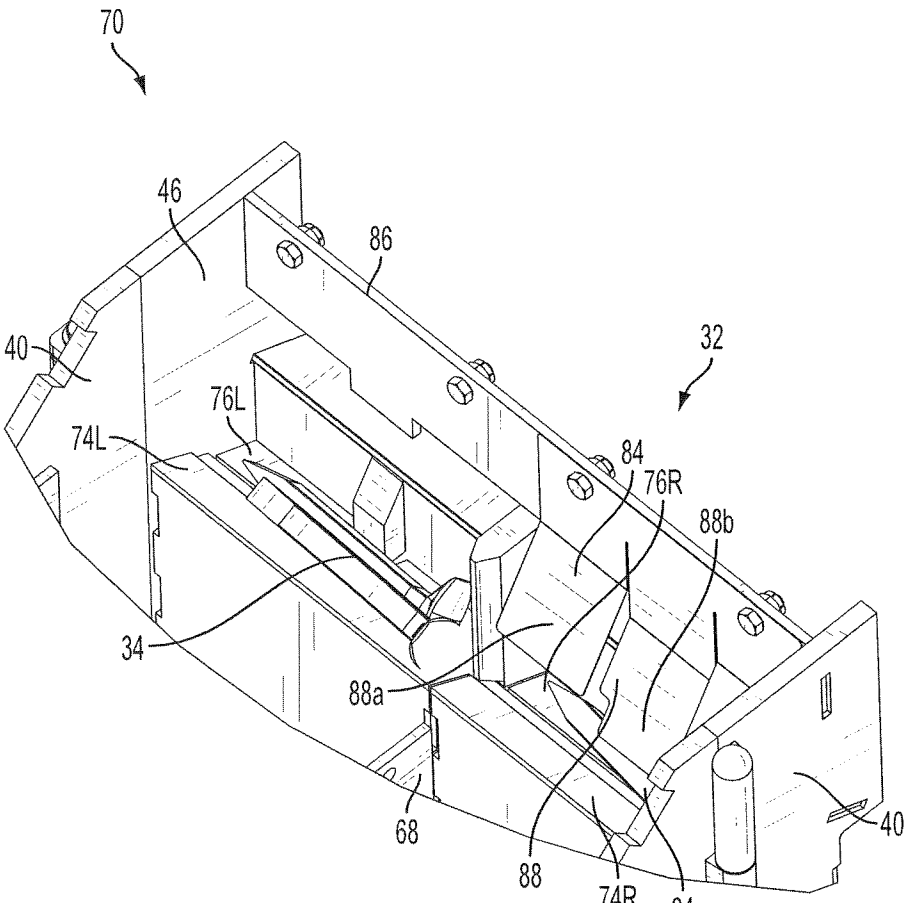
FIG. 13 is an enlarged fragmentary perspective view of the singulator depicted in FIG. 12 showing spikes being pushed upward by the fourth stage.
Figure 14:
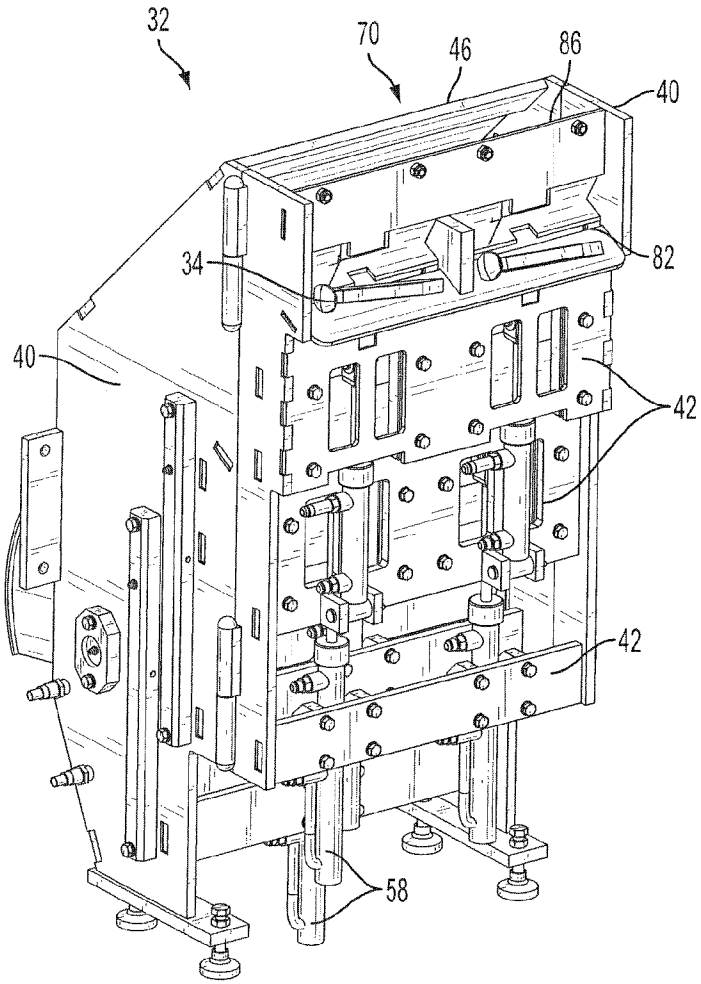
FIG. 14 is a top perspective of the present singulator showing spikes being delivered from the fourth stage to a desired destination.

Referring now to FIGS. 6, 12 and 13, as is the case with the primary elevator 48, the stages 74, 76 of the secondary elevator 70 each reciprocate between a second lower position (stage 74 in FIG. 6) in which the second platform 80 of the third stage 74 receives a further reduced number of the spikes 34, hopefully only one, and a second upper position (stage 74 in FIG. 13). In the case of the fourth stage 76, in the second upper position, the spike 34 is delivered to a desired location 82 (FIG. 14). In the case of the fourth stage 76, the desired location 82 is an outlet ramp (FIG. 14). Also the third and fourth stages 74, 76 operate in opposite reciprocal cycles similarly to the stages 52, 54 such that when a first elevator in one of the stages is in an up position, the corresponding elevator in the counterpart stage is in a down position.

An important distinction between the primary and the secondary elevators 48, 70 is that in the secondary elevators, the second platforms 80 are smaller in area than the first platforms 60, 62. This reduction in area is intended to limit the number of spikes 34 carried by the second platforms 80 so that preferably one and no more than two spikes reaches the desired location 82. In one embodiment, the first platforms 60, 62 are approximately 2 inches deep, and the second platforms 80 are approximately 1.25 inches deep, however the specific dimensions are not considered critical.

Further, as is the case with the primary elevator 48, to speed the delivery of spikes 34, in the secondary elevator 70, adjacent pairs of elevators 74R, 74L and 76R, 76L (FIGS. 4, 13) provide multiple supply paths of the spikes to the desired location. Since there are separate pairs of elevator members, there is no need for the divider bar 66 in the secondary elevator 70.

Referring now to FIGS. 12-14, to prevent more than one spike 34 from being delivered to the desired location 82, the singulator 32 is preferably provided with a multiple spike preventer 84. Fastened to the singulator 32 along an upper edge 86, the multiple spike preventer 84 is provided with at least one and preferably a plurality of biased, angled petals 88 which project towards the second platform 80 of the fourth stage 76. Biasing action is created by the angled orientation and the thin, plate-like preferably spring steel construction of the petals 88. It is further preferred to provide two distinct petal configurations, labeled 88*a*, and 88*b*, with the petals 88*b* being slightly longer than the petals 88*a*. The purpose of the petals 88*a* 88*b* is to prevent spikes 34 from being conveyed one on top of the other (FIG. 13). Further, the length of the petals 88*a* is intended to permit passage of a spike head 90 in the proper orientation (FIG. 14), while the petal 88*b* prevents passage of a spike head in that area.

Figure 3:
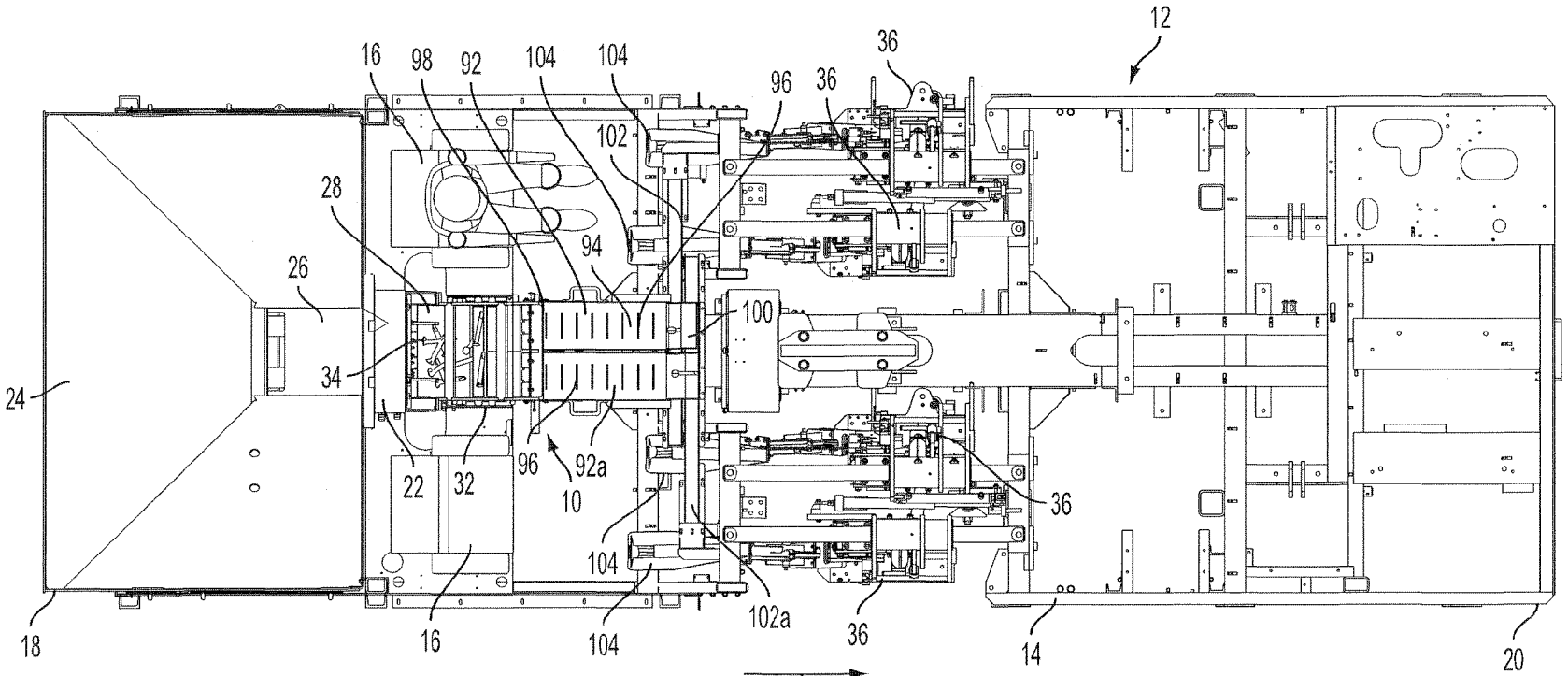
FIG. 3 is an overhead plan view of the machine of FIG. 1.
Figure 4:
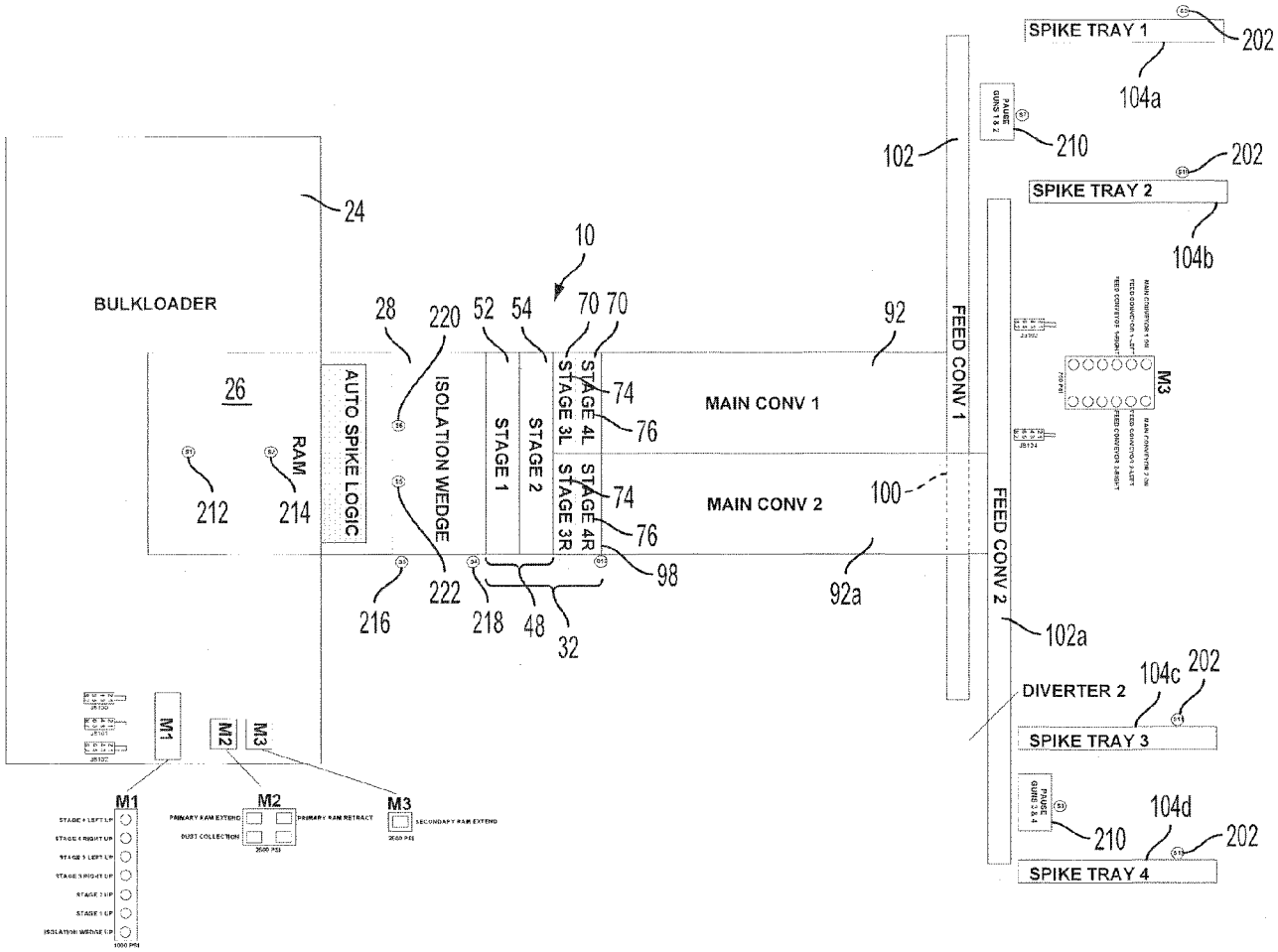
FIG. 4 is a schematic of an overhead plan of the present automatic spike feed system.

Referring now to FIGS. 3 and 4, while other arrangements are contemplated, depending on the construction and orientation of the rail maintenance vehicle 12, in the preferred embodiment the singulator 32 delivers the individual, sorted spikes 34 to at least one main conveyor 92 having a conveying direction along a longitudinal axis in the direction of travel (arrow A in FIG. 3), which preferably parallels the direction of the track being maintained. The number of main conveyors 92 may vary to suit the application, but in the preferred embodiment there are two such conveyors 92, 92*a*. As is well known in the art, the conveyors 92, 92*a* include driven endless belts 94 with optional cleats 96 (FIG. 3). Each main conveyor 92, 92*a* includes a receiving end 98 where spikes 34 are received from the singulator 32 and a feed end 100.

Referring now to FIG. 4, at the feed end 100, the spikes 34 are delivered to at least one feed conveyor 102 located in operational relationship to the feed end and having a second conveying direction transverse to the conveying direction of the main conveyor 92. While the number of feed conveyors 102 may vary to suit the situation, in the preferred embodiment there are two feed conveyors, labeled 102 and 102*a*. Both feed conveyors 102 are disposed transverse to the main conveyors 92, 92*a*, and are horizontally offset relative to each other. In function, the feed conveyors 102, 102*a* are constructed and arranged for delivering spikes 34 to a designated spike tray 104 for reorientation and ultimate delivery to the corresponding spiker gun 36. The system 10 is configured for work on either one or both rails or a railroad track. Thus, the feed conveyors 102, 102*a* are configured for optional reverse movement, such that, depending on the signal from the control system 22, a designated pair of spike trays, 104*a* and 104*b* feed spikes 34 to one rail, or alternately a designated pair of trays 104*c*, 104*d* feed spikes to the other rail, or all four trays are simultaneously fed with spikes, when both rails are designated to receive new spikes.

More specifically, the feed conveyor 102, receiving spikes 34 from the main conveyor 92, feeds spike tray 104*a* when operating in a first direction, and feeds spike tray 104*c* when operating in a second, reverse direction. Similarly, the feed conveyor 102*a*, receiving spikes 34 from the main conveyor 92*a*, feeds spike tray 104*b* when operating in a first direction, and feeds spike tray 104*d* when operating in a second, reverse direction. The delivery schedule is provided graphically below, with Guns 1-4 referring to the spike driver guns 36 fed respectively by the trays 104*a*-104*d*, and "x" indicating a particular gun is fed by a particular conveyor.

| Conveyor | Gun 1 | Gun 2 | Gun 3 | Gun 4 |
|---|---|---|---|---|
| Left Side Only | | | | |
| 92 | x | | | |
| 92a | | x | | |
| 102 | x | | | |
| 102a | | x | | |
| Right Side Only | | | | |
| 92 | | | x | |
| 92a | | | | x |
| 102 | | | x | |
| 102a | | | | x |

-continued

| Conveyor | Gun 1 | Gun 2 | Gun 3 | Gun 4 |
|---|---|---|---|---|
| Whole Machine | | | | |
| 92 | x | | x | |
| 92a | | x | | x |
| 102 | x | | x | |
| 102a | | x | | x |

102, 102a reverse direction automatically as required

Referring now to FIGS. 15-27, the spike trays 104*a*-*d* will be described in greater detail, and since they are substantially identical, will be referred to as trays 104. However, further disclosure of the spike trays 104 is provided in commonly-assigned U.S. Patent Application (docket 1425.82247) incorporated by reference.

Figure 15:
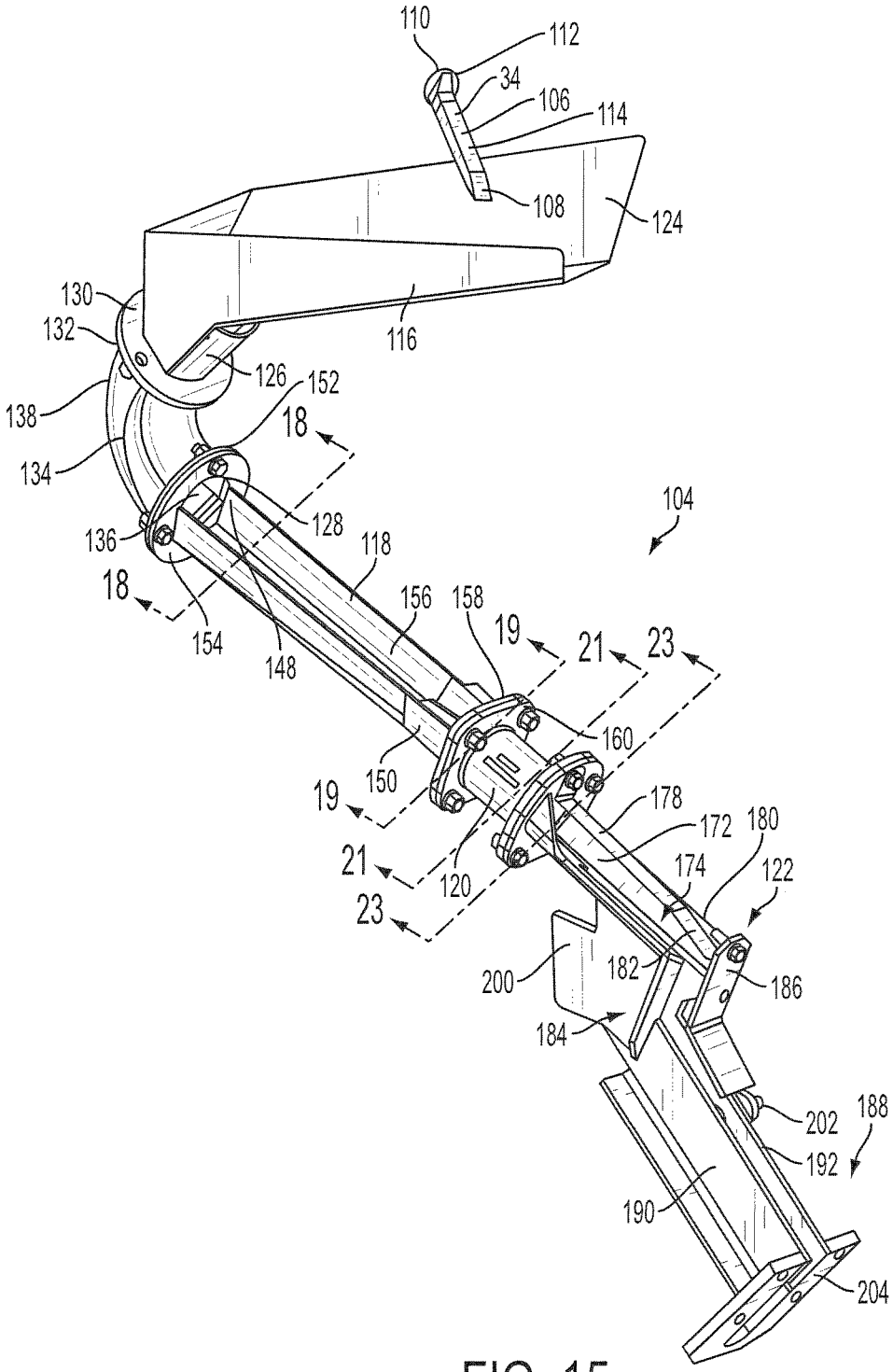
FIG. 15 is a top perspective view of the present spike tray with a spike being fed into the Upper Basket.
Figure 16:
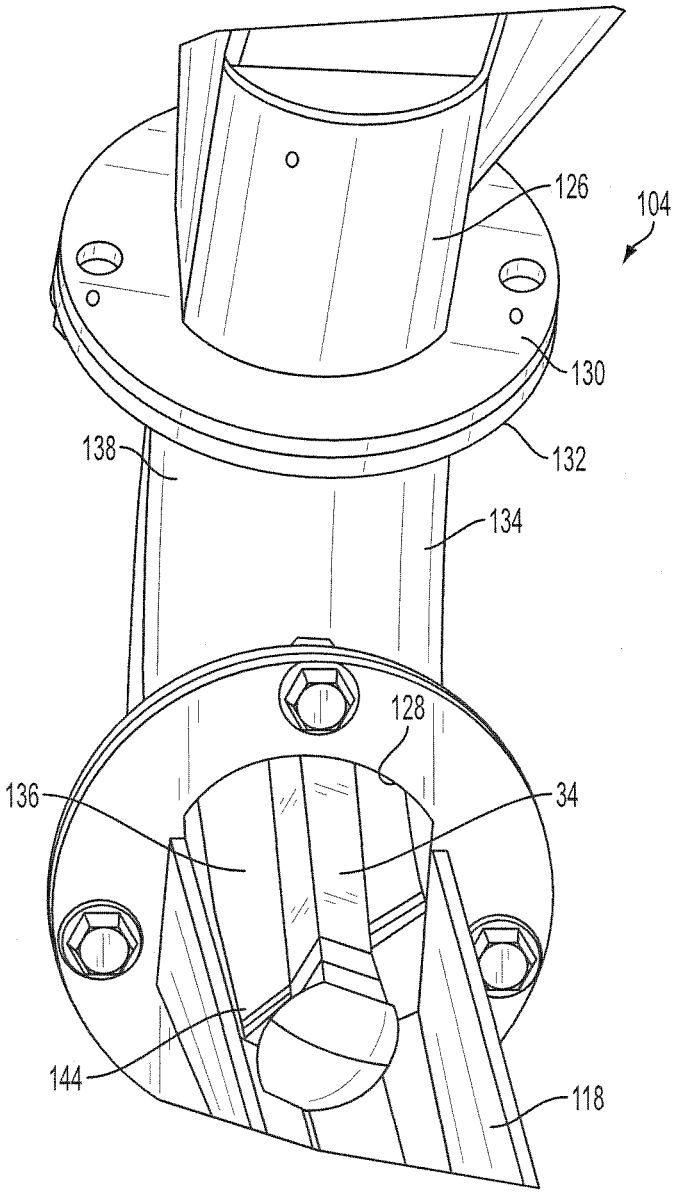
FIG. 16 is an enlarged fragmentary perspective of the junction of the Upper Basket with the Orientation Chute.
Figure 20:
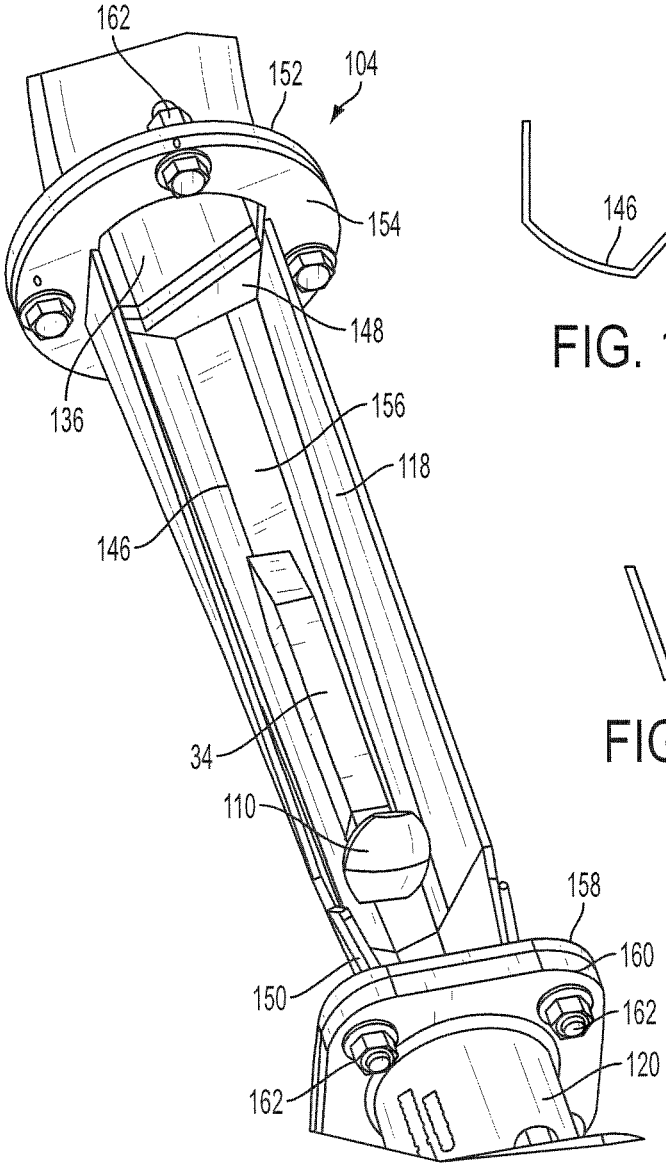
FIG. 20 is a top perspective view of a spike in the Orientation Chute.

Referring to FIGS. 15 and 22, the present spike tray 104 is constructed and arranged for orienting spikes 34 received from the feed conveyor 102 for insertion into the magazine of a spike driver 36. As used in the present application, a spike 34, here a rail cut spike, has a shank portion 106 with a tip 108 at one end, and a head 110 at the opposite end from the tip. As is well known in the art, the shank portion 106 is typically square or rectangular in transverse cross-section, and defines a longitudinal axis of the spike 34. Also, the head 110 is offset on the shank portion 106, so that an edge 112 of the head projects laterally from a corresponding side 114 of the shank portion. In FIGS. 15, 20 and 22, the spike 34 is shown in a head-up orientation, while in FIG. 16, the spike is shown in a head-down orientation.

In view of the above-described background the present tray 104 is provided for orienting and transporting spikes 34 by conveying the spikes in the direction of travel and including a series of connected, function-oriented static regions configured for orienting the spike from a random orientation to a desired tip-down orientation. In the present application, "static" refers to the fact that the regions do not have moving parts such as robotic arms, etc. and the spikes 34 are manipulated by contour, inclination and/or geometry. At least one of the regions is inclined for facilitating movement of the spike 34 through the regions, and the regions are configured such that proper orientation of the spike is achieved without operator contact.

Returning now to FIG. 15, the present tray 104 includes four or five major components or regions. At an upper end, an Upper Basket or basket 116 receives the spikes 34 in a variety of orientations, including tip 108 first or head 110 first. Connected to the Upper Basket 116 is an Orientation Chute or chute 118, an Orientation Twist or twist 120, and the Lower Spike Tray or LST 122. Included in the Upper Basket 116 is a hopper 124 having a funnel 126 configured for receiving a spike 34 to begin the orientation process. A lower end of the hopper 124 defines a tubular opening 128.

Referring now to FIGS. 15, 16 and 17A-17C, a radial flange 130 on the basket 116 connects to a corresponding flange 132 on a tubular elbow portion or elbow 134, such that the tubular opening 128 and the elbow define a basket passageway 136. It is contemplated that the elbow 134 may be considered a separate component of the tray 104, depending on the application, hence there may be four or five major regions. Spikes 34 of any orientation are delivered to the basket 116, but more frequently are delivered tip first or head first, and the objective of the basket and the elbow 134 is to orient the spikes so that the longitudinal axis of the spike is oriented in the direction of travel through the tray 104 (FIG.

16). The Upper Basket 116 is disposed vertically above the elbow 134 to feed the spikes 34 to the elbow by gravity.

Figure 17A:
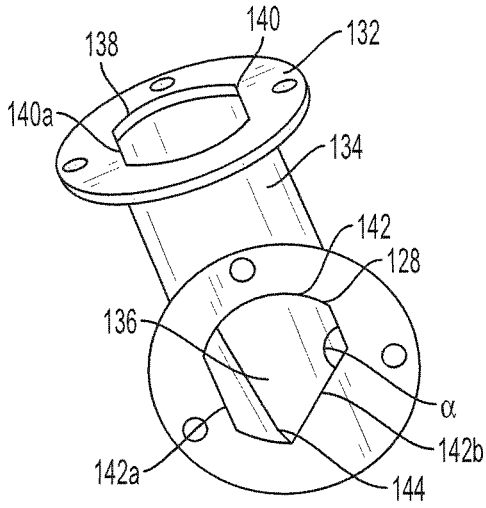
FIG. 17A is a bottom perspective view of the present elbow shown disassembled from the chute.
Figure 17B:
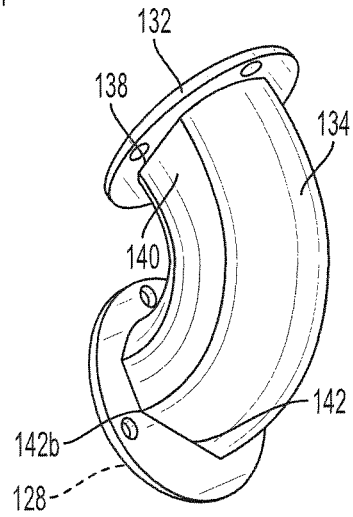
FIG. 17B is a first lower side perspective view of the elbow of FIG. 17A.
Figure 17C:
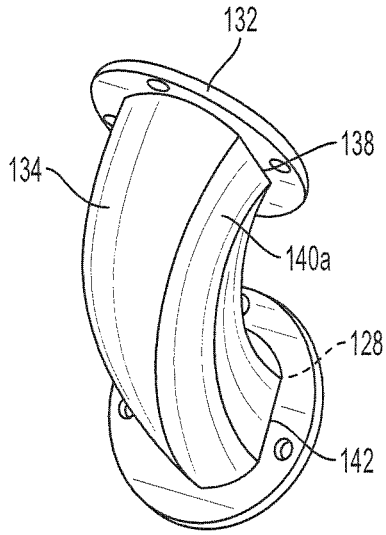
FIG. 17C is a second lower side perspective view of the elbow of FIG. 17A.
Figure 18:
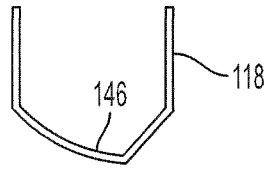
FIG. 18 is a vertical cross-section of the Orientation Chute taken along the line 18-18 of FIG. 15 and in the direction generally indicated.
Figure 19:
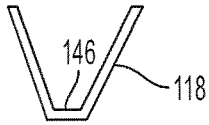
FIG. 19 is a vertical cross-section of the Orientation Chute taken along the line 19-19 of FIG. 15 and in the direction generally indicated.

As seen in FIGS. 17A-17C, a preferred construction of the tubular elbow 134 facilitates the desired orientation of the spike 34 by providing a changing configuration from a first end 138, which is generally oval and symmetrical, with a pair of parallel, straight sides 140, 140*a*. A second, opposite end 142 of the elbow 134 has a first side 142*a* which is straight, but a second side 142*b* defines an obtuse angle a and the end 142 also defines a narrowed, somewhat "V"-shaped outlet 144 that causes spikes 34 passing through the elbow 134 to assume the desired orientation with respect to the direction of travel. Other elbow configurations are contemplated provided the desired function of spike orientation is achieved.

Referring now to FIGS. 16 and 18-20, next, the spike 34 travels by gravity through the elbow 134 to the Orientation Chute 118, where geometry of a chute bottom surface 146 orients the spikes so that the head 110 is facing up, regardless of whether the spikes are tip first or head first in the chute. A combination of the amount of inclination of the chute 118, the length of the chute, a narrowing cross-sectional geometry of the chute, which is also asymmetrical in cross-section (FIG. 18), and an optional coating of low friction material such as TEFLON® material on the chute combine to cause the spike 34 to be slidably and rotationally oriented to the desired position (FIG. 20), basically because the spike is heavier and more stable in the head-up position. It is contemplated that variations of the above-identified parameters may be used to adjust the velocity of the spike 34 in the chute 118 to achieve proper orientation, depending on the application. In the preferred embodiment, the chute 118 is generally "U"-shaped in cross-section, and gradually narrows from a first end 148 connected to the Upper Basket 116, and a second end 150 connected to the Orientation Twist 120. As is the case with the Upper Basket 116, connection of the chute 118 to the Upper Basket is preferably accomplished using flanges 152, 154 or similar structure known in the art, however direct welding or other fastening technologies are contemplated. It has also been found that by providing the elbow 134 with the narrowed outlet 144 provides additional time for the spike 34 to be properly rotationally oriented as shown in FIG. 20. Also, the chute 118 defines a chute passageway 156 in communication with the basket passageway 136. In the preferred tray 104, the angle of inclination of the chute 118 is approximately 25°, however other angles are contemplated depending on the situation and the type of spike to be oriented.

Figure 23:
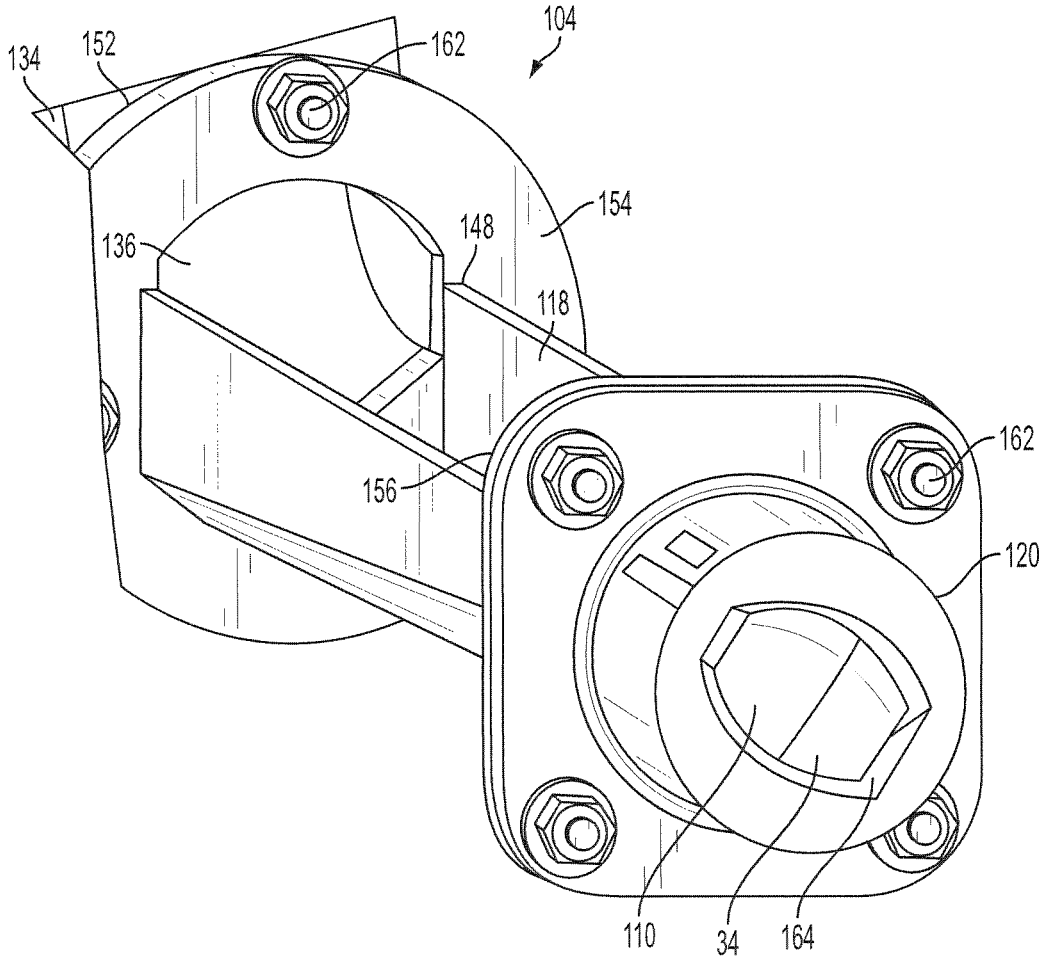
FIG. 23 is a top perspective view of the Orientation Chute showing a cross-section taken along the line 23-23 of FIG. 15 and in the direction generally indicated.

Referring now to FIGS. 20, 21 and 23, following the Orientation Chute 118, the spikes 34 travel by gravity, either tip 108 first or head 110 first, in a head-up orientation to the Orientation Twist 120. Regardless of orientation, the spikes 34 are oriented with their longitudinal axis in the direction of travel. As is common to other portions of the tray 104, the chute 118 is connected to the twist 120 using radial flanges 158, 160 secured by fasteners 162, welding or other fastening technologies, as is well known in the art. In the Orientation Twist 120, a helical pathway 164 is defined, is in communication with the chute passageway 156 and is preferably shaped in cross-section to slidingly accommodate the head 110 and yet rotate the head a desired amount. The pathway 164 is preferably dimensioned to slidingly accommodate heads 110 of a variety of types of spikes 34. Preferably, the twist 120 is configured such that the spikes 34 are rotated at the head 110, either clockwise or counterclockwise in the range of 20 to 70° from vertical. The direction of rotation, clockwise or counterclockwise, depends on which side of the rail is the ultimate destination of the spikes 34. Thus trays 104*a* and 104*c* will have one direction of rotation, and trays 104*b* and 104*d* will have an opposite direction of rotation. At an exit 166 of the twist 120 (FIG. 24), the spikes 34 retain this orientation.

Figure 24:
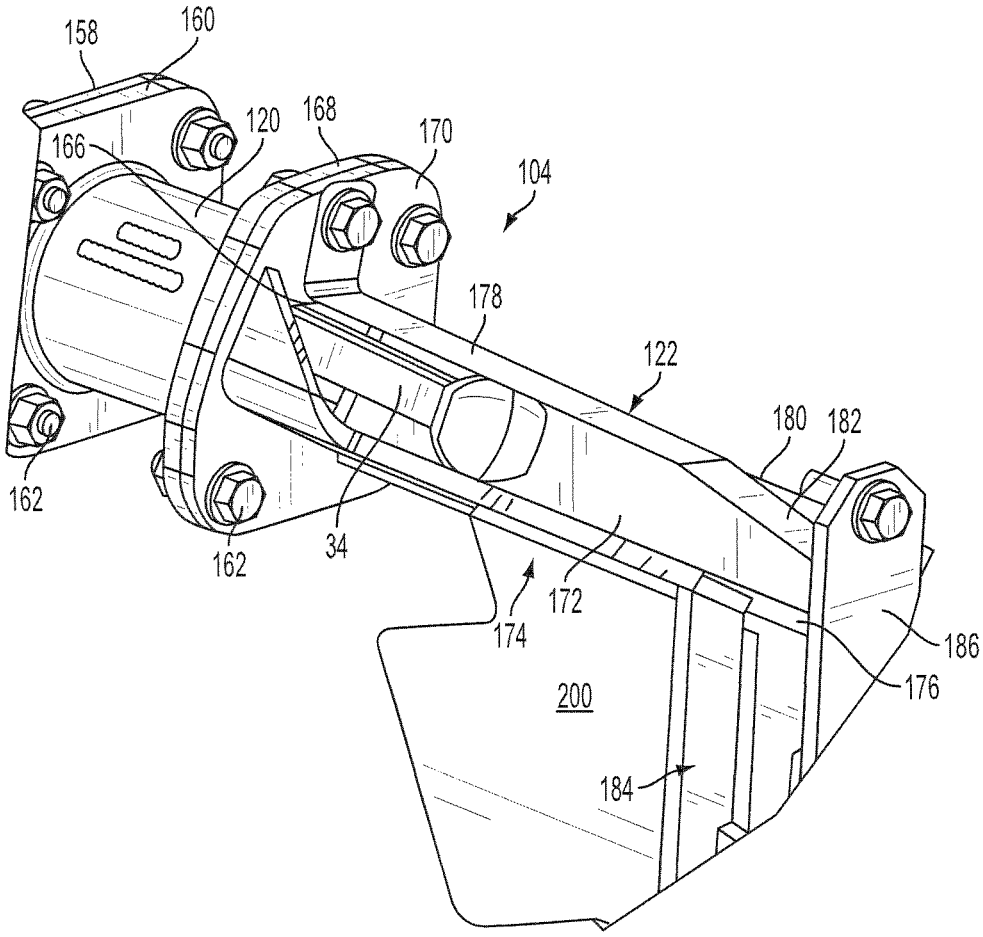
FIG. 24 is a fragmentary top perspective view of the Lower Spike Tray showing a spike entering the Tray.
Figure 25:
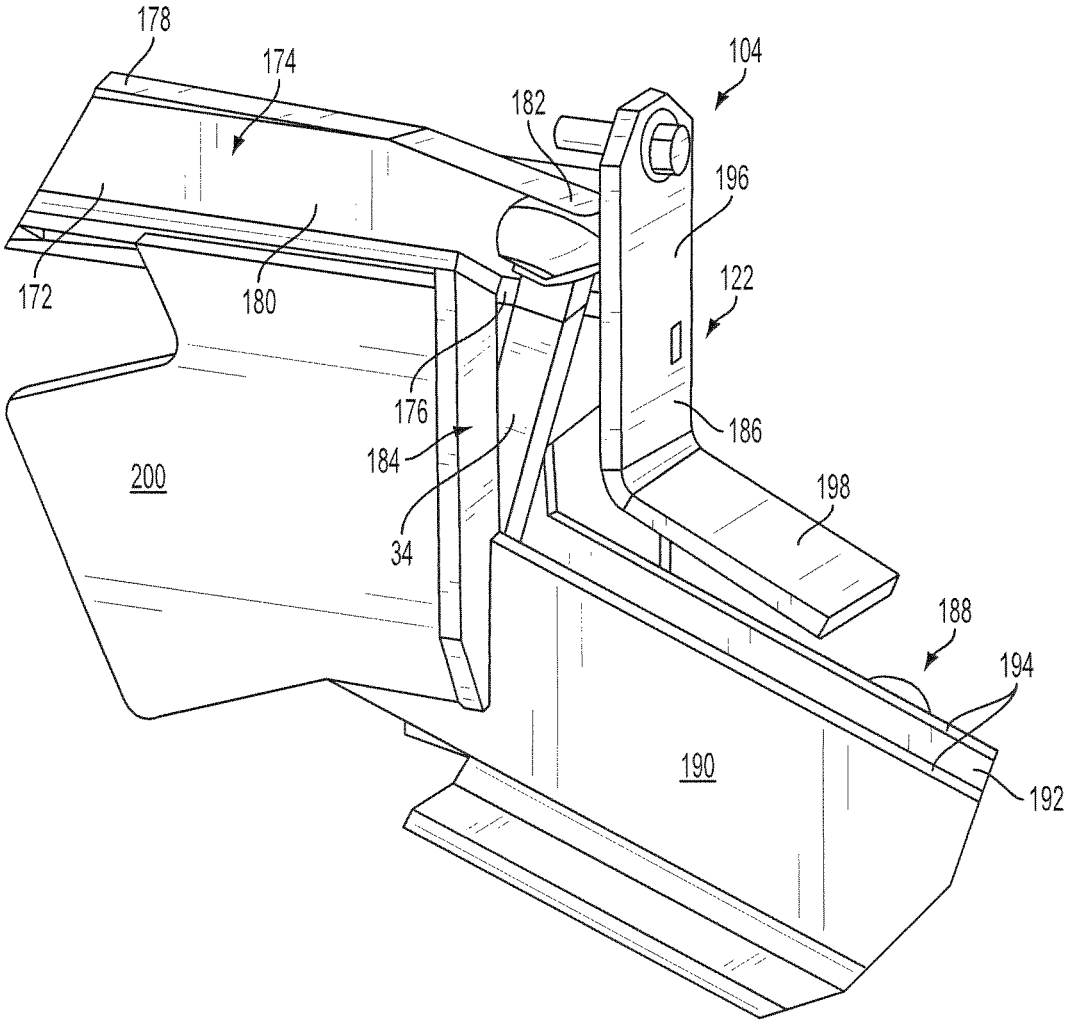
FIG. 25 is a fragmentary top perspective of a first stage of the Lower Spike Tray showing a spike becoming oriented tip down.
Figure 26:
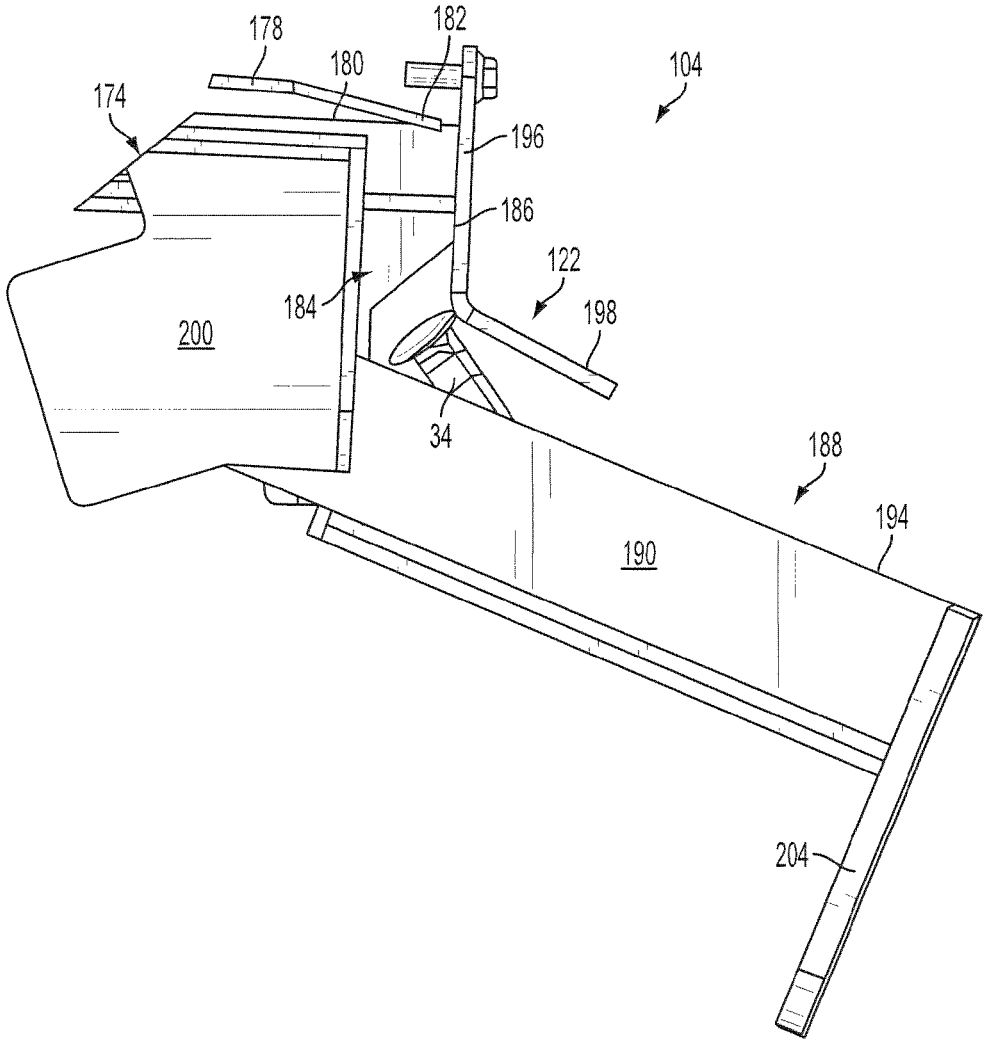
FIG. 26 is a side elevation of a second stage of the Lower Spike Tray showing a spike entering the stage.
Figure 27:
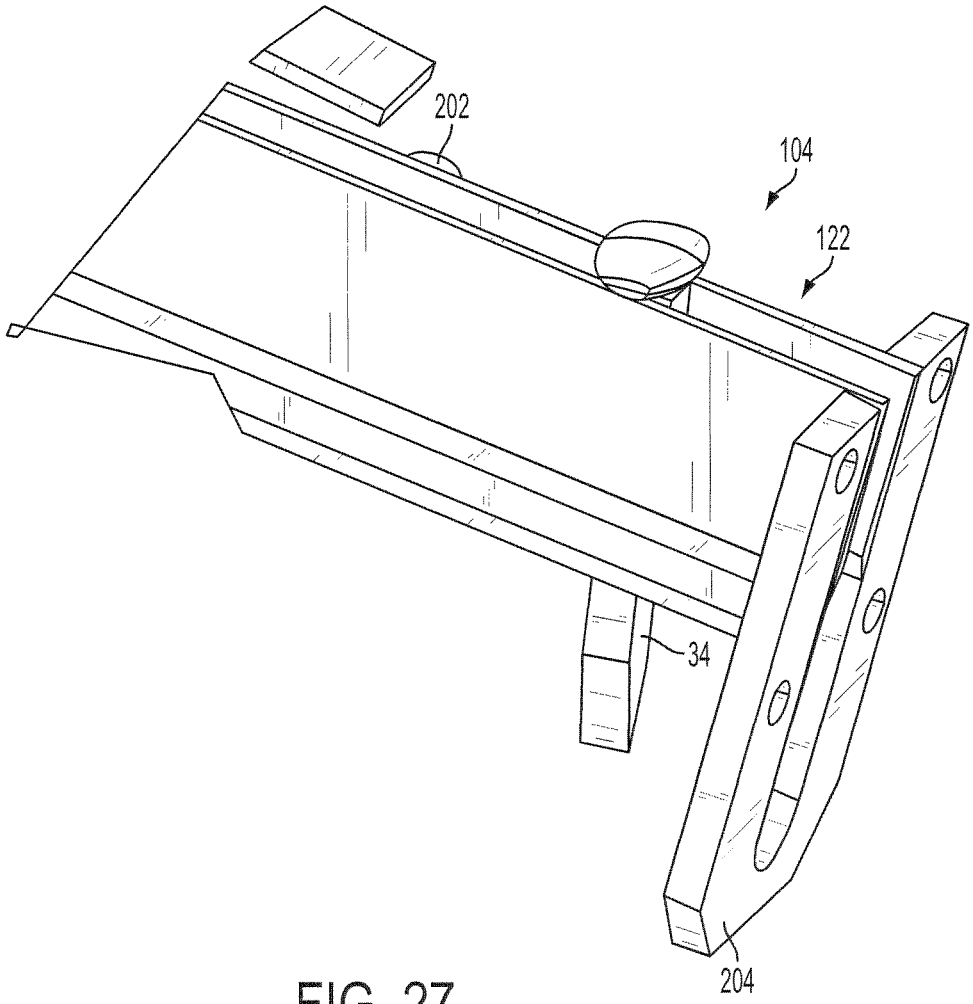
FIG. 27 is a fragmentary top perspective view of the second stage of the Lower Spike Tray showing the spike in a properly oriented position for delivery to the spike feeder tray of a spiker magazine.

Referring now to FIGS. 15, 23 and 24, the Lower Spike Tray 122 is connected to the twist 120 using corresponding flanges 168, 170 and the fasteners 162. The helical pathway 164 of the twist 120 is in communication with a channel 172, which is generally "Z"-shaped to correspond to the shape of the LST 122 when viewed from the side (FIG. 15). As is the case with the chute 118 and the twist 120, the LST 122 is inclined for promoting gravity flow of the spikes 34, but other angles are contemplated as described above.

The lower spike tray 122 is configured for receiving the spikes 34 in a rotated head orientation, and has a first zone 174 with a generally tubular, open-topped configuration and a sufficient length for receiving spikes from the twist 28. While other angles are contemplated, the first zone 174 is preferably inclined at 25° from horizontal. In the LST 122, the spikes 34 are initially oriented with their axes in the direction of travel, and are either tip first or head first, with the head rotated 20 to 70° relative to vertical. As the spikes 34 progress through the LST 122, the configuration of the tray causes the spike to change orientation.

Once cleared of the twist 120, the spikes 34 encounter a slot 176 extending along an axis of the first zone 174 and dimensioned for accommodating only the tips 108 and the shank portion 106, so that the spikes achieve a head-up, tip-down orientation, with the heads 110 maintaining the orientation of the twist 120. At this point, the head direction will either be left in a counter clockwise tray, or right in a clockwise tray. An optional component of the first zone 174 is an elongate, biased keeper 178 partially enclosing an upper end 180 of the first zone for maintaining proper head orientation of the spikes 34. The keeper 178 is fastened to the flange 170 and has a free end 182.

Referring now to FIGS. 15 and 24-26, at the end of the first zone 174, the LST 122 is provided with a second, transition zone 184 in communication with the channel 172 and defining a backstop 186 for receiving the spikes 34 sliding down the inclined lower spike tray, and causing the spikes to fall vertically in a tip-down position to engage a third, spike feed zone 188 defined by spaced, parallel plates 190 creating a path 192 accommodating the spikes such that heads 110 of the spikes slidingly engage upper edges 194 of the plates defining the path. While other angles are contemplated depending on the application, the third spike feed zone 188 is preferably angled at 45° relative to horizontal. It will be understood that the transition zone 184 is not inclined as are other components of the tray 104. This construction is intended to reduce the velocity of the spikes 34 as they progress down the path 192.

In the preferred embodiment, the backstop 186 is secured to the tray 104 and is generally "L"-shaped, with a first, generally vertically oriented leg 196 which performs the backstop function, and a second, generally horizontally or obliquely oriented leg 198 serving as an anti-swing bracket disposed above the plates 190 for preventing spikes 34 from swinging out from the slot 176 or the transition zone 184 as they fall in the transition zone to the third zone 188. It will be appreciated that the first leg 196 also assists in maintaining alignment of the spikes 34 in the transition zone 184.

Referring now to FIGS. 15, and 24-27, a pair of opposed, generally spaced, "V"-oriented guide plates 200 connects the first zone 174 to the third zone 188. The plates 200 are preferably welded in place or secured by other fastening technologies. Further, an optional spike sensor 202 is mounted to the LST 122, preferably on one of the plates 190, for sensing spikes passing through the LST. Signals are then transmitted through the control system 22 to the companion components such as the singulator 32, for adjusting the flow of spikes 34 to meet the demand. If a plurality of spikes 34 are located in the spiker magazine, and as such become backed up in the LST 122, the sensor 202 will signal the control system 22 to divert spikes to another spike tray 104. In this manner, the control system 22 is constructed and arranged for monitoring the feed rate of spikes transmitted from the bulk feeder to the spike driving mechanism as a function of the number of spikes in a magazine of at least one of the spiker guns 36. A lower end of the LST 122 forms a generally "U"-shaped flange 204 defining a tray outlet 206 for securing the LST to a magazine of a spiker gun 36, known in the art and described in the patents incorporated by reference.

Referring now to FIG. 4, in addition to the LST sensor 202, one of which is provided to each spike tray 104*a-d*, the control system 22 is also connected to a pair of gun pause sensors 210 that respectively pause delivery to either trays 104*a* or 104*b*, or alternately 104*c* or 104*d* if a jam is sensed in the spiker gun 36. Upon sensing a jam in one of the trays 104*a-d*, a signal is sent to the control system 22. A resulting diversion of spikes 34 is handled by reversing the flow of the feed conveyors 102, 102*a*. A pair of ram sensors 212, 214, respectively sense the retraction and extension limits of the ram 26. Another pair of sensors, 216, 218 respectively sense the upward and downward extents of the movement of the separator 28. In addition, another pair of sensors 220, 222 is mounted in the area of the top surface 30 of the separator 28 for monitoring the size of the supply of spikes 36 provided by the ram 26.

In operation, spikes 34 are fed from the bulk bin 24 onto the separator 28 with the bulk bin ram 26. When either one or both of the spike demand sensors 220, 222 is triggered by the incoming pile of spikes 34, or a maximum timer value, the ram 26 stops and the separator 28 pivots up and transfers spikes onto the first stage 52 of the singulator 32. The ram 26 has an upper and lower limit. When the ram 26 reaches the upper limit, the ram can be automatically sent down to the lower limit upon receipt of a signal from a singulator portion of the control system 22. The ram 26 also has manual override switches (not shown). Regardless of whether the program is running or not, the ram 26 is movable forward or backward as need by the operator with a 3-way momentary switch (not shown). If the program is running when the operator uses the switch, the singulator 32 and the conveyors 92, 102 will pause. As soon as the operator releases the switch, the singulator 32 and the conveyors 92, 102 will resume operation.

The singulator 32 reduces the spike pile from the separator 28 to a generally single spike through the operation of the vertically reciprocating stages 52, 54, 74 and 76. The spikes 34 exit stage 76 of the singulator 32 in a horizontal orientation and transverse to the direction of travel. Each spike 34 then slides onto main conveyors, 92 or 92*a*, and subsequently onto feed conveyor 102 and/or 102*a*. The feed conveyors 102, 102*a* will transfer the spikes 34 to the correct spike tray 104*a-d* and associated spiker gun 36, depending on the gun mode being used. Each spike 34 will fall into the designated spike tray 104*a-d*, and then via gravity and certain geometry of the spike tray, will be oriented into a desired position. Generally, the spike head 110 will face the rail and the spike tip 108 will be pointed downward. Each spike tray 104*a-d* includes one high limit sensor 202 configured for inputting either a full or not signal into the control system 22. The singulator 32 and the conveyors 92, 102 will run as needed to keep the spike trays 104*a-d* in use filled with spikes 34.

While a particular embodiment of the present automatic spike feeder system has been shown and described, it will be appreciated by those skilled in the art that changes and modifications may be made thereto without departing from the invention in its broader aspects and as set forth in the following claims.

What is claimed:

1. An automatic rail spike feeder system for use with a rail maintenance vehicle having a bulk storage bin for containing a supply of spikes, and at least one spike driving mechanism, comprising:

a mechanism constructed and arranged for receiving a supply of spikes from the storage bin and for automatically delivering individual spikes to the at least one spike driving mechanism in a desired orientation without operator contact of the spikes;

a separator configured for receiving a supply of the spikes from the bulk storage bin and separating a portion of the supply for orientation; and said mechanism including at least one singulator constructed and arranged for receiving the portion of the spike supply from the separator and having at least one reciprocating elevator for separating the spikes and delivering them sequentially to a desired location.

2. The automatic rail spike feeder system of claim 1, wherein said separator includes a platform for receiving the portion of the spike supply and pivoting from a first position adjacent the supply to a second position inclined relative to said first position for delivering the portion to a singulator.

3. The automatic rail spike feeder system of claim 1, wherein each said singulator includes a plurality of reciprocating elevators including a first group of stages each with a first platform for conveying the spikes, and a second group of stages each with a second platform for conveying the spikes, the second platforms having a smaller area than said first platforms.

4. The automatic rail spike feeder system of claim 1 wherein each said singulator includes a first elevator having a plurality of sequentially arranged reciprocating stages configured for feeding spikes to a fixed shelf, and a second elevator having a plurality of reciprocating stages arranged for receiving spikes from said fixed shelf.

5. The automatic rail spike feeder system of claim 1 further including at least one conveyor disposed for receiving spikes delivered by said at least one singulator and conveying them to at least one designated spike tray.

6. The automatic rail spike feeder system of claim 5 wherein said at least one conveyor includes at least one main conveyor having a first conveying direction, a receiving end and a feed end, and at least one feed conveyor located in operational relationship to said feed end and having a second conveying direction transverse to said first direction.

7. The automatic rail spike feeder of claim 5 wherein said at least one spike tray has a plurality of function-specific regions, including individual portions each configured for orienting the spike in a designated one of a longitudinal axis of the spike is in the direction of travel, a head-up orientation, and the tip-down orientation.

8. An automatic spike feeder system for automatically conveying rail spikes from a bulk storage bin to a spike driving mechanism, comprising:

a singulator configured for receiving groups of randomly-oriented spikes from the storage bin and including at least one vertically reciprocating elevator for isolating single spikes for delivery; and at least one spike tray constructed and arranged for receiving the single spikes from said singulator and for automatically and statically orienting the single spikes from a random orientation to delivery in a designated tip down orientation for delivery to the spike driving mechanism, such that the spikes are conveyed from the storage bin to the spike driving mechanism without operator contact.

9. The automatic rail spike feeder system of claim 8 further including at least one conveyor disposed for receiving spikes delivered by said singulator and conveying them to said at least one designated spike tray.

10. The automatic rail spike feeder system of claim 9, wherein said at least one conveyor includes at least one main conveyor having a first conveying direction, a receiving end and a feed end, and at least one feed conveyor located in operational relationship to said feed end and having a second conveying direction transverse to said first direction.

11. The automatic spike feeder system of claim 10, further including a control system constructed and arranged for monitoring the feed rate of spikes transmitted from the bulk feeder to the spike driving mechanism as a function of the number of spikes in a magazine of the at least one spike driver mechanism.

12. The automatic spike feeder system of claim 11, wherein said control system is configured for changing said second conveying direction upon receipt of sensor input of at least one of a jammed spike driving mechanism or a filled spike driving mechanism magazine.

13. The automatic spike feeder system of claim 8, further including a control system constructed and arranged for monitoring the feed rate of spikes transmitted from the bulk feeder to the spike driving mechanism as a function of the number of spikes in a magazine of the at least one spike driver mechanism.

14. An automatic spike feeder system for automatically conveying rail spikes from a bulk storage bin to a spike driving mechanism, comprising:

a separator configured for receiving a supply of the spikes and separating a portion of the supply for orientation;

a singulator configured for receiving the portion of randomly-oriented spikes from said separator and including at least one vertically reciprocating elevator for isolating single spikes for delivery;

at least one conveyor disposed for receiving spikes delivered by said singulator and conveying them to at least one designated spike tray; and said at least one spike tray constructed and arranged for receiving the single spikes from said singulator and for automatically and statically orienting the single spikes from a random orientation to delivery in a designated tip down orientation for delivery to the spike driving mechanism, such that the spikes are conveyed from the storage bin to the spike driving mechanism without operator contact.

* * * * *